US010215343B2

(12) United States Patent
Haberkorn et al.

(10) Patent No.: US 10,215,343 B2
(45) Date of Patent: Feb. 26, 2019

(54) LED LIGHTING DEVICE HAVING AN IMPROVED LED HOLDER

(71) Applicant: LEDVANCE GmbH, Garching bei Munchen (DE)

(72) Inventors: Lene Haberkorn, Königsbronn (DE); HuaLi Yu, Guangdong (CN); Klaus Eckert, Herbrechtingen (DE); Baijin Xu, Guangdong (CN); Lambert Frye, Steinheim (DE); Jitao Liu, Guangdong (CN); Qian Xie, Guangdong (CN); Liqin Li, Guangdong (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 15/706,094

(22) Filed: Sep. 15, 2017

(65) Prior Publication Data

US 2018/0080612 A1 Mar. 22, 2018

Related U.S. Application Data

(63) Continuation-in-part of application No. 15/705,675, filed on Sep. 15, 2017.

(30) Foreign Application Priority Data

Sep. 16, 2016 (DE) ..... 10 2016 117 450
Nov. 7, 2016 (CN) ..... 2016 1 0977226

(51) Int. Cl.

| | |
|---|---|
| ***F21V 21/00*** | (2006.01) |
| ***F21K 9/232*** | (2016.01) |
| ***F21K 9/238*** | (2016.01) |
| ***H01J 5/52*** | (2006.01) |
| ***F21V 29/65*** | (2015.01) |

(Continued)

(52) U.S. Cl.

CPC ..... *F21K 9/232* (2016.08); *F21K 9/238* (2016.08); *F21V 3/02* (2013.01); *F21V 19/0045* (2013.01); *F21V 29/65* (2015.01); *H01J 5/52* (2013.01); *F21K 9/90* (2013.01); *F21V 29/506* (2015.01); *F21Y 2103/10* (2016.08); *F21Y 2107/00* (2016.08); *F21Y 2107/30* (2016.08); *F21Y 2115/10* (2016.08); *H01J 5/58* (2013.01)

(58) Field of Classification Search

CPC ..... F21K 9/232

See application file for complete search history.

(56) References Cited

U.S. PATENT DOCUMENTS

2010/0253221 A1* 10/2010 Chiang ..... F21K 9/00 315/32
2014/0268779 A1 9/2014 Sorensen et al.

(Continued)

FOREIGN PATENT DOCUMENTS

CN 204005447 U 12/2014
CN 104534302 A 4/2015

(Continued)

*Primary Examiner* — Sean Gramling
(74) *Attorney, Agent, or Firm* — Hayes Soloway PC

(57) ABSTRACT

A lighting device comprises a holder for LED filaments. The holder has a first electrically conductive holding structure and a second electrically conductive holding structure. Each holding structure comprises an essentially longitudinal connection section and an attachment section essentially perpendicular to the connection section.

20 Claims, 2 Drawing Sheets

(51) Int. Cl.

| | |
|---|---|
| ***F21V 3/02*** | (2006.01) |
| ***F21V 19/00*** | (2006.01) |
| *F21Y 103/10* | (2016.01) |
| *H01J 5/58* | (2006.01) |
| *F21Y 115/10* | (2016.01) |
| *F21V 29/506* | (2015.01) |
| *F21Y 107/30* | (2016.01) |
| *F21Y 107/00* | (2016.01) |
| *F21K 9/90* | (2016.01) |

(56) References Cited

U.S. PATENT DOCUMENTS

| | | | |
|---|---|---|---|
| 2014/0312760 | A1 | 10/2014 | Augustine |
| 2015/0009689 | A1 | 1/2015 | Chen et al. |

FOREIGN PATENT DOCUMENTS

| | | | |
|---|---|---|---|
| CN | 104676322 | A | 6/2015 |
| CN | 104763900 | A | 7/2015 |
| CN | 104791627 | A | 7/2015 |
| CN | 204611431 | U | 9/2015 |
| CN | 204852983 | U | 12/2015 |
| CN | 205424484 | U | 8/2016 |
| DE | 202014004861 | U1 | 8/2014 |
| DE | 102013223904 | A1 | 5/2015 |
| EP | 2236907 | A2 | 10/2010 |
| JP | S6074260 | A | 4/1985 |

* cited by examiner

LED LIGHTING DEVICE HAVING AN IMPROVED LED HOLDER

CROSS-REFERENCE TO RELATED APPLICATIONS AND PRIORITY

This patent application is a Continuation-In-Part of U.S. patent application Ser. No. 15/705,675 filed on Sep. 15, 2017 and claims priority from German Patent Application No. 102016117450.5 filed on Sep. 16, 2016, and Chinese Patent Application No. 201610977226.6 filed on Nov. 7, 2016. Each of these patent applications is herein incorporated by reference in its entirety.

TECHNICAL FIELD

The present invention relates to a LED lighting device, in particular a lighting device using LED filaments which are attached to an improved holder.

BACKGROUND

A specific type of LED lighting devices uses LED filaments, i.e. strip-like LED elements which typically comprise a plurality of LEDs arranged in a row on a transparent strip-like carrier (e.g. glass or sapphire materials). The LEDs may be coated by a coating for converting the light generated by the LEDs into a desired wavelength range. Multiple LED filaments are usually arranged inside a bulb of a lighting device. For ensuring a specific arrangement of the LED filaments with respect to each other and for supplying the LED filaments with electrical power a holder is needed.

Known holders, such as for example disclosed in Chinese patent CN 204573938 U, consist of multiple elements and are, therefore, rather complicated to manufacture and, thus, expensive. Often, manual work is required for manufacturing the holder.

SUMMARY OF THE INVENTION

In view of the known prior art, it is an object of the present invention to provide an improved lighting device, in particular a lighting device with a holder which can be easily machine-made.

This object is solved by a lighting device according to the independent claim. Preferred embodiments are given by the dependent claims.

A lighting device according to the present invention comprises a translucent bulb, in particular a transparent bulb, a base having at least two electrical contacts, and a light engine arranged inside the bulb. The bulb can be made from glass or a plastic material. The base can for example be a screw base (e.g. E14), a bayonet base (e.g. GU10), a bi-pin base (e.g. G4), or any other type of lamp base. The light engine inside the bulb comprises one or more LED filaments attached to a holder. The light engine may comprise 4, 5, 6, 7, 8 or any other number of LED filaments. Preferably, the LED filaments are arranged such that not all LED filaments are positioned parallel to each other, in order to minimize the generation of shadows.

The holder has a first electrically conductive holding structure and a second electrically conductive holding structure. Each LED filament is connected with a first end to the first holding structure and with a second end to the second holding structure. Apart from the connection via the LED filaments, the first holding structure and the second holding structure are electrically isolated from each other. Preferably, the LED filaments are connected to the holding structures such that an electrically parallel connection (as opposed to an electrically serial connection) is obtained.

The first holding structure is connected to a first electrical contact of the base and the second holding structure is connected to a second electrical contact of the base. The connection of the first and second holding structure to the electrical contacts of the base may either be direct (i.e. the holding structure itself is connected to the electrical contact or the holding structure is connected to an electrically conductive element such as a wire which in turn is connected to the electrical contact) or indirect (i.e. the holding structure is connected to an electrical driving circuit for driving the LEDs and the driving circuit (also known as driver) is in turn connected to the electrical contact).

Thus, applying an electrical voltage to the electrical contacts of the lamp base in turn supplies the LED filaments and, accordingly, the LEDs on the LED filaments with an electrical voltage. In the case of a direct connection of the holding structures to the electrical contacts, the voltage supplied to the LED filaments is the voltage applied to the electrical contacts. In the case of an indirect connection of the holding structures to the electrical contacts, the voltage supplied to the LED filaments is determined by the driving circuit.

The holder may be supported inside the bulb by a glass stem which can be melted during manufacture of the lighting device. The holder, i.e. the ends of the connection sections of both holding structures, is then inserted into the molten stem. After cooling of the stem, the holder is fixedly attached to the stem.

Alternatively, the holder may comprise fixation elements at the end of the connection section of each holding structure. The fixation elements can be attached to separate connectors that have been inserted into the glass stem as described above. In this case, an electrical voltage is supplied to the LED filament via the separate connectors, the fixation elements, and then the holding structures. Such fixation elements are described in German patent application DE 102016117450.5 which is incorporated herein by reference in its entirety.

Each of the first holding structure and the second holding structure comprises an essentially longitudinal connection section and an attachment section essentially perpendicular to the connection section. The LED filaments are attached to the attachments section, such that an electrical connection as well as a mechanical connection between LED filaments and holding structure is achieved. The connection section connects the attachment section to the electrical contacts of the lamp base (if a driving circuit is used, indirectly via the driving circuit). The connection section and the attachment section can be different parts of a single element or they can be constituted by different elements which are electrically conductively and mechanically connected to each other, for example, they can be soldered or welded together.

For each holding structure, both the connection section and the attachment section are electrically conductive. Thus, no further elements are needed for mechanically holding the LED filaments in their desired positions and for achieving their electrical connection to the electrical contacts of the lamp base. Accordingly, such a holder is simple and easy to manufacture, especially in an automated production line.

In a preferred embodiment, at least one of the first holding structure and the second holding structure is formed from a wire. The wire is preferably made from steel, in particular stainless steel, and may be plated with nickel or another metal. The wire may have a diameter between approximately 0.8 mm to approximately 2.5 mm. Holding structures fabricated from such a wire are stable enough to mechanically support the LED filaments in their desired positions. Manufacturing a holding structure from a wire by bending the wire into the shape of the holding structure is easy and can easily be included in an automated production line.

Each holding structure may be manufactured by bending the holding structure as a whole from a single wire. Alternatively, a holding structure may be manufactured by bending two or more pieces of the holding structure from a wire each and then connecting the pieces with each other electrically conductively, e.g. by soldering or welding.

In a preferred embodiment, at least one of the attachment section of the first holding structure and the attachment section of the second holding structure has a circular or a polygonal circumference. The term "circular" also includes an elliptical shape or other small deviations from the mathematical shape of a circle, e.g. egg-shaped. A polygonal shape includes polygons with 3, 4, 5, 6, 7, 8, or more sides. The sides of the polygon may all have the same length but may also have different lengths. The number of sides of the polygon may equal the number of LED filaments attached to the polygon. The LED filaments may be attached to a polygon at the corners of the polygon or along its sides.

Preferably, the attachment section can be formed by bending a wire into the desired, for example circular or polygonal, shape. Such an attachment section is particularly easy to manufacture.

In a preferred embodiment, at least one of the connection section of the first holding structure and the connection section of the second holding structure has the shape of a straight line. The connection section can, in particular be constituted by a straight wire. This further simplifies manufacture.

In a preferred embodiment, for at least one of the holding structures the connection section is connected to the respective attachment section by a radial section. This allows positioning the connection section at a suitable location with respect to the attachment section. In particular if the connection section as well as the attachment section is made from a wire, the connection section must not be located at the circumference of the attachment section but can also be located towards the "interior" of the attachment section. The connection section can, however, also be positioned at a point along the circumference of the attachments section. In that case, no additional radial section is necessary.

The radial section can lie essentially in the plane of the respective attachment section or it can be arranged under an angle with respect to the plane of the respective attachment section. In the former case, the upper end of the connection section is at approximately the same height than the attachment section, in the latter case, the upper end of the connection section lies at a lower height than the attachment section.

In a preferred embodiment, the holder comprises a bridge element attached to the first holding structure and the second holding structure, wherein the bridge element is not electrically conductive. The bridge element can in particular be made from a plastic material. The bridge element can stabilize the holder by fixing the relative position of the two holding structures with respect to each other at the position of the bridge element.

In a preferred embodiment, the bridge element comprises a front portion and a rear portion connectable to the front portion, wherein at least one of the front portion and the rear portion comprises grooves for accommodating the first holding structure and the second holding structure. The front portion and the rear portion may be connected by an additional element acting as a hinge during closing of the bridge element, i.e. during attaching the bridge element to the two holding structures. The front portion and the read portion may be connected by a snap fit connection.

In a preferred embodiment, at least one of the connection section of the first holding structure and the connection section of the second holding structure comprises an anti-rotation portion for preventing rotation of the bridge element around the respective holding structure. Such an anti-rotation portion may be constituted by a bend, preferably by a zig-zag bend in the wire from which the connection section is made. If the bridge element is located at the position of the anti-rotation portion, e.g., if the bend is located inside the bridge portion, rotation of the bridge element with respect to the connection section is prevented, further increasing stability of the holder.

BRIEF DESCRIPTION OF THE DRAWINGS

Preferred embodiments of the invention will be explained in the following, having regard to the drawings. It is shown in.

DETAILED DESCRIPTION OF THE INVENTION

In the following, preferred embodiments of the invention will be described with reference to the drawings. The same or similar elements or elements having the same effect may be indicated by the same reference number in multiple drawings. Repeating the description of such elements may be omitted in order to prevent redundant descriptions.

Figure 1:
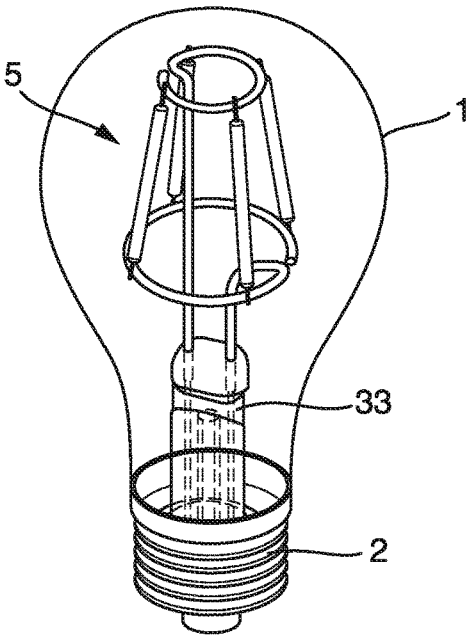
FIG. 1 a schematic view of an embodiment of a lighting device according to the present invention.
Figure 2:
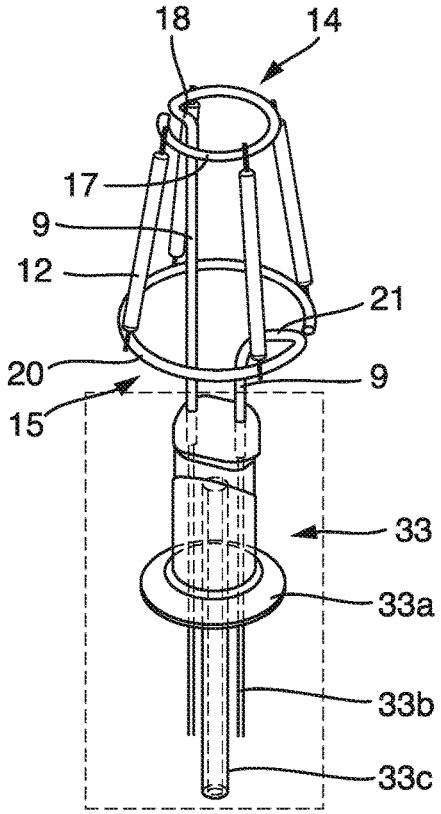
FIG. 2 a schematic view of an embodiment of a light engine of the lighting device according to FIG. 1.

FIG. 1 shows a schematic view of an embodiment of a lighting device according to the present invention. An enlarged view of the light engine is shown in FIG. 2. The lighting device (in this case a retrofit lamp (hereinafter referred to simply as "lamp"), suitable for replacing known incandescent lamps) comprises a glass bulb 1, a light engine 5 arranged inside the bulb 1, and a lamp base 2 with an Edison type screw base. In order to enhance thermal dissipation and prolong the life of the lamp, the bulb can be filed with a gas having high thermal conductivity. Preferably, the gas contains helium and/or hydrogen.

The light engine comprises a holder having a first holding structure 14 and a second holding structure 15. Both holding structures are made from a wire (e.g. nickel plated stainless steel with a diameter between approximately 0.8 mm to approximately 2.5 mm) by bending the wire into the shape of the holding structure. The first holding structure 14 comprises an annular attachment section 17 which is attached to its connection section 9 via a radial section 18.

The attachment section 17 is arranged essentially perpendicular to the straight connection section 9. The radial section 18 lies essentially in the plane of the attachment section 17. The lower end of the connection section 9 is fixedly held by a glass stem 33.

The stem 33 comprises a flange 33*a*, two lead wires 33*b* and a glass tube 33*c*. During production of the lamp, the bulb 2 can be evacuated and filled with a gas having high thermal conductivity through the tube 33*c* which is then closed by melting.

The second holding structure 15 comprises an annular attachment section 20 which is attached to its connection section 9 via a radial section 21. The attachment section 20 is arranged essentially perpendicular to the straight connection section 9. The radial section 21 lies essentially in the plane of the attachment section 20. The lower end of the connection section 9 is fixedly held by a glass stem 33.

In both attachment sections 17,20 the end of the wire lies next to the point where the attachment section 17,20 meets the corresponding radial section 18,21.

Since both holding structures 14,15 are made by bending a single wire, their production can easily be integrated into an automated production line. No soldering or welding is necessary for the production of the holding structures. Nevertheless, the completed holder is strong enough to support the LED filaments.

The LED filaments 12 are electrically conductively attached with their electrical contacts 13 to the attachment sections 17,20 of both holding structures 14,15, e.g. by soldering or welding.

The LED filaments are connected in parallel such that the LED filaments work independently from each other. Accordingly, even if one of the LED filaments should fail, the lamp is still able to operate, thus prolonging the life of the lamp.

Figure 3:
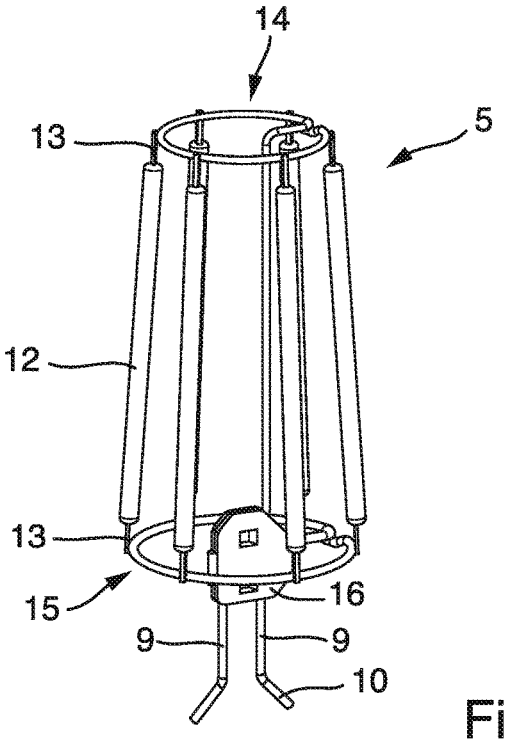
FIG. 3 a schematic view of another embodiment of a light engine according to the present invention.
Figure 4:
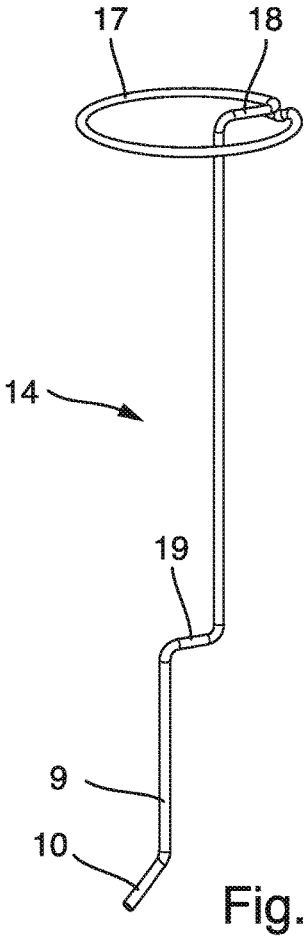
FIG. 4 a schematic view of the first holding structure of the light engine according to FIG. 3.
Figure 5:
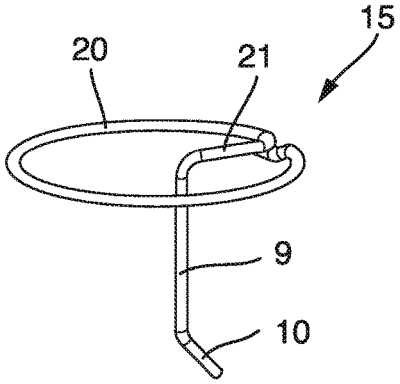
FIG. 5 a schematic view of the second holding structure of the light engine according to FIG. 3.

FIG. 3 shows a schematic view of another embodiment of a light engine according to the present invention. Details of this embodiment are shown in FIGS. 4-7. The holder of the light engine shown in FIG. 3 comprises a first holding structure 14 and a second holding structure 15. Both holding structures are made from a wire (e.g. nickel plated stainless steel with a diameter between approximately 0.8 mm to approximately 2.5 mm) by bending the wire into the shape of the holding structure. A bridge 16 is attached to both holding structures 14,15 and stabilizes the holder.

The first holding structure 14 comprises an annular attachment section 17 which is attached to its connection section 9 via a radial section 18. The attachment section 17 is arranged essentially perpendicular to the straight upper portion of the connection section 9. The radial section 18 lies essentially in the plane of the attachment section 17.

The connection section 9 includes a zig-zag bend 19, i.e. two bends of approximately 90°. The two bends of the zig-zag bend 19 are arranged such that the upper portion of connection section 9 and the lower portion of connection section 9 are essentially parallel to each other. In other words, the upper portion of connection section 9, the lower portion of connection section 9, and the zig-zag bend 19 essentially lie in the same plane. The end of the lower portion of connection section 9 is bent by an angle of approximately 45°, thus resulting in a fixation element 10 which serves for attaching the light engine 5 to connectors held for example by a glass stem.

The second holding structure 15 comprises an annular attachment section 20 which is attached to its connection section 9 via a radial section 21. The attachment section 20 is arranged essentially perpendicular to the straight connection section 9. The radial section 21 lies essentially in the plane of the attachment section 20. The end of the lower portion of connection section 9 is bent by an angle of approximately 45°, thus resulting in a fixation element 10 which serves for attaching the light engine 5 to connectors held for example by a glass stem.

In both attachment sections 17,20 the end of the wire runs parallel to a portion of the attachment section 17,20. The end of the wire can include a S-shaped bend next the point where the attachment section 17,20 meets the corresponding radial section 18,21 so that the end of the wire lies slightly below (alternatively above, inside, or outside) the attachment section 17,20. The end of the wire may be electrically conductively connected to the respective attachment section 17,20.

Figure 6:
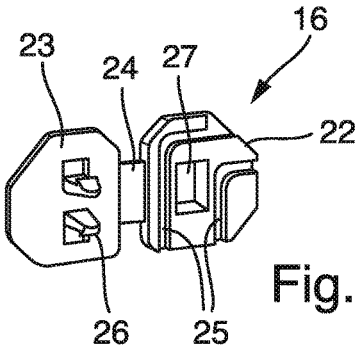
FIG. 6 a schematic view of the bridge of the light engine according to FIG. 3.

The bridge 16 is shown in an unmounted state in FIG. 6. The bridge 16 comprises a front portion 23 and a rear portion 22 connected to each other by a flexible hinge element 24. The rear portion 22 comprises two channels 25. The depth of the channels 25 is approximately equal to or greater than the thickness of the wire from which the holding structure 14,15 are made. Both channels 25 have an angle of approximately 90°. Thus, the zig-zag bend 19 of the first holding structure 14 and the 90° bend at the inner end of the radial portion 21 of the second holding structure 15 can be received by the channels 25. Thereafter, the front portion 23 of the bridge 16 can be moved over the rear portion 22 and can be fixed to the rear portion 22 by means of latches 26 on the front portion 23 engaging window 27 in the rear portion 22. Thus, bridge 16 is closed and fixates the two holding structures 14,15 with respect to each other. The bridge 16 is made from an electrically non-conductive plastic material (e.g. by injection molding), isolating the two holding structures 14,15 from each other. Since the part of the zig-zag bend 19 of the first holding structure and the 90° bend of the second holding structure are covered by the bridge 16, rotation of the bridge 15 with respect to either holding structure 14,15 is prevented.

Figure 7:
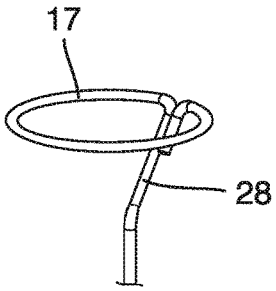
FIG. 7 a schematic view of a detail of another embodiment of a holding structure of a light engine according to the present invention.

FIG. 7 shows schematically another embodiment of an upper portion of the first holding structure 14. An upper portion of the second holding structure 15 could also be designed in this alternative form. In this alternative embodiment, the radial section 28 does not lie in the plane of the attachment section 17, but rather at an angle to the plane downwards and inwards. The end of the wire does not run along the attachment section 17 (as shown in FIG. 6) but along the radial section 28. The end of the wire may be electrically conductively connected to the radial section 28.

While the above holding structure have been described as being bent from a single wire, it is also possible to bend two or more portions of one or both holding structures of a holder separately and attach them to each other, e.g. by soldering or welding. For example, a first wire section can be bent into a circle (attachment section) and a second wire portion can be bent into an L-shape (radial section and connection section). The end of one arm of the L can then be welded to the circle to obtain a holding structure as shown above in FIGS. 1 and 2. Other separations of a holding structure into portions to be bent separately are also envisioned by the invention.

Although the invention has been illustrated and described in detail by the explained embodiments, it is not limited to these embodiments. Other variations may be derived by the skilled person without leaving the scope of the attached claims.

Generally, "a" or "an" may be understood as singular or plural, in particular with the meaning "at least one", "one or more", etc., unless this is explicitly excluded, for example by the term "exactly one", etc.

In addition, numerical valued may include the exact value as well as a usual tolerance interval, unless this is explicitly excluded.

Features shown in the embodiments, in particular in different embodiments, may be combined or substituted without leaving the scope of the invention.

LIST OF REFERENCE NUMBERS

1 bulb
2 base
5 light engine
9 connection section
10 fixation element
12 LED filament
13 electrical contact of LED filament
14 first holding structure
15 second holding structure
16 bridge
17 attachment section of first holding structure
18 radial section of first holding structure
19 zig-zag bend
20 attachment section of second holding structure
21 radial section of second holding structure
22 rear portion of bridge
23 front portion of bridge
24 hinge element
25 channel
26 latch
27 window
33 glass stem
33*a* flange
33*b* lead wire
33*c* glass tube

The invention claimed is:

1. A lighting device comprising a translucent bulb, a base having at least two electrical contacts, and a light engine arranged inside the bulb, the light engine comprising one or more LED filaments attached to a holder, the holder having a first holding structure that is electrically conductive and a second holding structure that is electrically conductive, wherein each LED filament is connected with a first end to the first holding structure and with a second end to the second holding structure, wherein the first holding structure is connected to a first electrical contact of the base and the second holding structure is connected to a second electrical contact of the base, characterized in that the first holding structure and the second holding structure each comprise an essentially longitudinal connection section and an attachment section essentially perpendicular to the connection section, wherein for at least one of the first holding structure and the second holding structure, the connection section is connected to the respective attachment section by a radial section.

2. The lighting device according to claim 1, wherein at least one of the attachment section of the first holding structure and the attachment section of the second holding structure has a circular or a polygonal circumference.

3. The lighting device according claim 1, wherein at least one of the connection section of the first holding structure and the connection section of the second holding structure has the shape of a straight line.

4. The lighting device according to claim 1, wherein the radial section lies essentially in the plane of the respective attachment section.

5. The lighting device according to claim 1, wherein the radial section is arranged under an angle with respect to the plane of the respective attachment section.

6. The lighting device according to claim 1, wherein at least one of the first holding structure and the second holding structure is formed from a wire.

7. The lighting device according to claim 1, wherein the holder comprises a bridge element attached to the first holding structure and the second holding structure, wherein the bridge element is not electrically conductive.

8. The lighting device according to claim 7, wherein the bridge element comprises a front portion and a rear portion connectable to the front portion, wherein at least one of the front portion and the rear portion comprises grooves for accommodating the first holding structure and the second holding structure.

9. The lighting device according to claim 7, wherein at least one of the connection section of the first holding structure and the connection section of the second holding structure comprises an anti-rotation portion for preventing rotation of the bridge element around the respective holding structure.

10. A lighting device comprising a translucent bulb, a base having at least two electrical contacts, and a light engine arranged inside the bulb, the light engine comprising one or more LED filaments attached to a holder, the holder having a first holding structure that is electrically conductive and a second holding structure that is electrically conductive, wherein each LED filament is connected with a first end to the first holding structure and with a second end to the second holding structure, wherein the first holding structure is connected to a first electrical contact of the base and the second holding structure is connected to a second electrical contact of the base, characterized in that the first holding structure and the second holding structure each comprise an essentially longitudinal connection section and an attachment section essentially perpendicular to the connection section, wherein the holder comprises a bridge element attached to the first holding structure and the second holding structure, wherein the bridge element is not electrically conductive, wherein at least one of the connection section of the first holding structure and the connection section of the second holding structure comprises an anti-rotation portion for preventing rotation of the bridge element around the respective holding structure.

11. The lighting device according to claim 10, wherein at least one of the attachment section of the first holding structure and the attachment section of the second holding structure has a circular or a polygonal circumference.

12. The lighting device according claim 10, wherein at least one of the connection section of the first holding structure and the connection section of the second holding structure has the shape of a straight line.

13. The lighting device according to claim 10, wherein for at least one of the first holding structure and the second holding structure, the connection section is connected to the respective attachment section by a radial section, wherein the radial section lies essentially in the plane of the respective attachment section.

14. The lighting device according to claim 13, wherein the radial section is arranged under an angle with respect to the plane of the respective attachment section.

15. The lighting device according to claim 10, wherein at least one of the first holding structure and the second holding structure is formed from a wire.

16. The lighting device according to claim 10, wherein the bridge element comprises a front portion and a rear portion connectable to the front portion, wherein at least one of the front portion and the rear portion comprises grooves for accommodating the first holding structure and the second holding structure.

17. The lighting device according to claim 10, wherein the anti-rotation portion is provided as at least one bend in the corresponding at least one of the connection section of the first holding structure and the connection section of the second holding structure.

18. The lighting device according to claim 17, wherein the at least one bend is received by a corresponding groove formed in the bridge element.

19. The lighting device according to claim 17, wherein the at least one bend is arranged perpendicular to the corresponding at least one of the connection section of the first holding structure and the connection section of the second holding structure.

20. The lighting device according to claim 17, wherein the at least one bend is provided as a first bend of approximately 90° and a second bend of approximately 90°, in a zig-zag pattern.

* * * * *